US005608950A

United States Patent [19]

Noguchi

[11] Patent Number: 5,608,950

[45] Date of Patent: Mar. 11, 1997

[54] FILE WITH GRIPPING DEVICES

[75] Inventor: Toshio Noguchi, 542-5, Koyama, Matsudo-shi, Chiba-ken, Japan

[73] Assignees: Toshio Noguchi, Matsudo; Yasushi Yamaguchi, Tokyo, both of Japan; Colleague Iowa, Inc., Iowa; Colleague Agencies, Inc., Tokyo, Japan

[21] Appl. No.: 563,095

[22] Filed: Nov. 27, 1995

[30] Foreign Application Priority Data

Aug. 23, 1995 [JP] Japan ..... 7-250037

[51] Int. Cl.[6] ..... A44B 1/00

[52] U.S. Cl. ..... 24/67.3; 24/67 R; 24/346; 24/545

[58] Field of Search ..... 24/67.3, 67 R, 24/545, 546, 547, 531, 346

[56] References Cited

U.S. PATENT DOCUMENTS

| | | | |
|---|---|---|---|
| 549,660 | 11/1895 | Rodden | 24/67.3 |
| 857,488 | 6/1907 | Rosenthal | 24/67 R |
| 1,539,457 | 5/1925 | Berneburg | 24/67.3 |
| 1,736,558 | 11/1929 | van Buren | 24/67.3 |
| 2,861,309 | 11/1958 | Saviolides | 24/67 R |
| 3,600,764 | 8/1971 | Froehlich, Jr. | 24/545 |
| 3,806,995 | 4/1974 | Gass | 24/346 |
| 5,086,545 | 2/1992 | Suzuki | 24/67.3 |

*Primary Examiner*—Victor N. Sakran
*Attorney, Agent, or Firm*—Kanesaka & Takeuchi

[57] ABSTRACT

A file for gripping sheets of the invention is formed of an elongated base member and a plurality of gripping devices attached to the base member. The base member is formed of upper and lower portions, a back portion situated between the upper and lower portions at a back side, and upper and lower guide members fixed to the upper and lower portions to face to each other at a front side. Each guide member diagonally extends toward the back portion. Each gripping device includes upper and lower frictional members with elasticity. The upper frictional member is fixed to the upper portion, and the lower frictional member is fixed to the lower portion to face to each other. When the sheets are inserted between the upper and lower portions, the sheets are guided by the guide members and are frictionally retained between the frictional members.

7 Claims, 2 Drawing Sheets

FILE WITH GRIPPING DEVICES

BACKGROUND OF THE INVENTION AND RELATED ART STATEMENT

The present invention relates to a file with gripping or holding devices to hold sheets or documents between the gripping devices without making holes to the sheets or using a pin.

When sheets or documents are assembled or attached together, the sheets may be simply connected together by a staple, and put into a file. In another method, holes may be formed in the sheets, and a strap or the like is inserted into the holes to assemble together, or the sheets with the holes may be attached to a file by the strap or the like. In these methods, since the staple is attached or the holes are formed, the sheets are damaged. Further, in case a sheet located under a top sheet is removed from a file, the top sheet must be removed from the file. Therefore, it takes time and trouble to remove a lower sheet from the file.

In case the staples and holes are not utilized, a device for binding sheets may be attached to a file, wherein a plate for gripping the sheets is urged to a base plate by a spring. In this case, the plate urged by the spring must be released when the sheet is added or removed. Also, the sheet can not be removed by one hand or without releasing the spring force.

In U.S. Pat. No. 5,086,545, a paper clip for gripping a sheet is formed of first and second brush plates facing to each other. When sheets are inserted into a portion between the first and second brush plates, the sheets are frictionally retained between the brush plates. The paper clip is used for clipping the sheets at one side thereof.

In view of the conventional file and the paper clip, the present invention has been made, and an object of the invention is to provide a file with gripping devices, wherein sheets can be easily attached to and detached from the file without using pins or holes.

Another object of the invention is to provide a file as stated above, wherein whole or a part of sheets can be easily removed from the file at one hand.

A further object of the invention is to provide a file as stated above, wherein the sheets attached to the file can not be detached easily.

Further objects and advantages of the invention will be apparent from the following description of the invention.

SUMMARY OF THE INVENTION

In accordance with the invention, a file for gripping sheets is formed of an elongated base member, and a plurality of gripping devices attached to the base member. The base member is formed of upper and lower portions disposed substantially parallel to each other, a back portion situated between the upper and lower portions at a back side thereof, and upper and lower guide members fixed to the upper and lower portions to face to each other at a front side. Each guide member diagonally extends toward the back portion so that when the sheets are inserted between the upper and lower portions, the sheets are guided in a center area between the upper and lower portions.

Each gripping member has upper and lower frictional members with elasticity. The upper frictional member is fixed to the upper portion, and the lower frictional member is fixed to the lower portion to face to each other. When the sheets are inserted between the upper and lower frictional members, the sheets are frictionally retained between the frictional members.

The mechanism and structure of the upper and lower frictional members are substantially the same as brush plates with hairs as disclosed in U.S. Pat. No 5,086,545. Therefore, the explanation of the brush plates with hairs as disclosed in U.S. Pat. No. 5,086,545 is incorporated in the present application.

In the file of the invention, the guide members are formed at the base member to guide the sheet in the center area between the base member. Also, at least two gripping devices are fixed to the elongated base member at a predetermined distance away from each other along a longitudinal direction thereof.

When the file is used, the sheets are inserted between the upper and lower portions. The sheets are guided by the guide members and are introduced between the upper and lower frictional members. The guided sheets can be easily held between the frictional members. The sheets held in the gripping devices do not accidentally removed from the file. However, when the sheets are strongly pulled, the sheets pulled are only removed from the file. The other sheets are held properly between the frictional members.

In the invention, the upper and lower guide members may be formed along the entire lengths of the respective upper and lower portions at the front sides thereof. Alternatively, the upper and lower guide members may be partly formed, e.g. at a portion between each gripping device and the front side of base member to face to each other.

The file may further include a back cover attached to the lower portion at the front side of the base member. Also, a front cover may be attached to the upper portion at the front side of the base member. The front and back covers may be integrally connected and situated inside the base member.

DETAILED DESCRIPTION OF PREFERRED EMBODIMENTS

Figure 1:
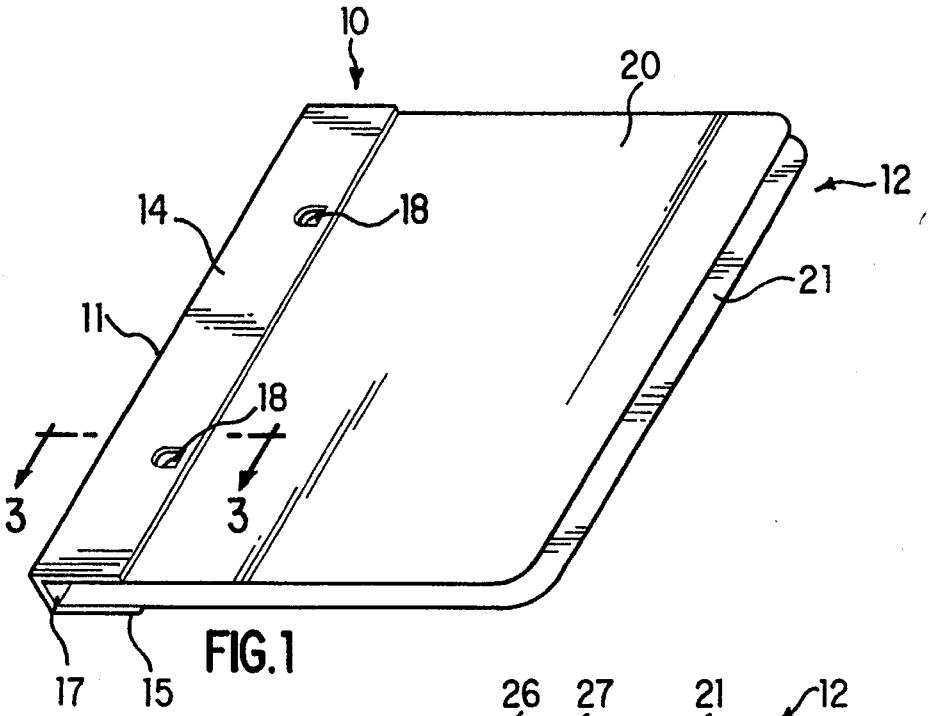
FIG. 1 is a perspective view of a first embodiment of a file of the present invention.
Figure 2:
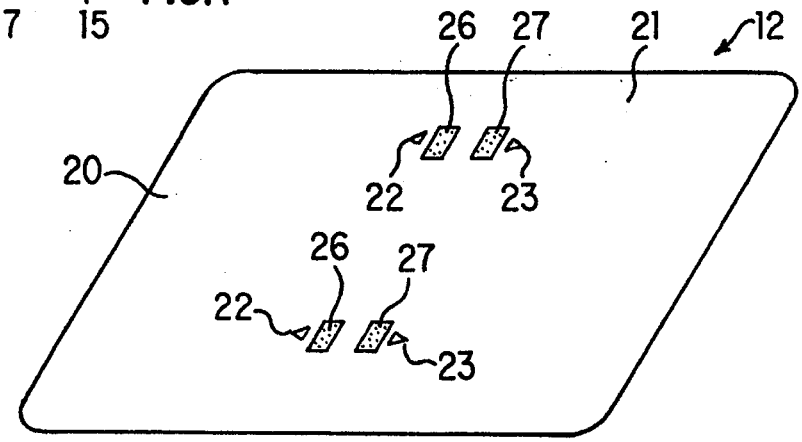
FIG. 2 is a perspective view of a cover used in the first embodiment.
Figure 3:
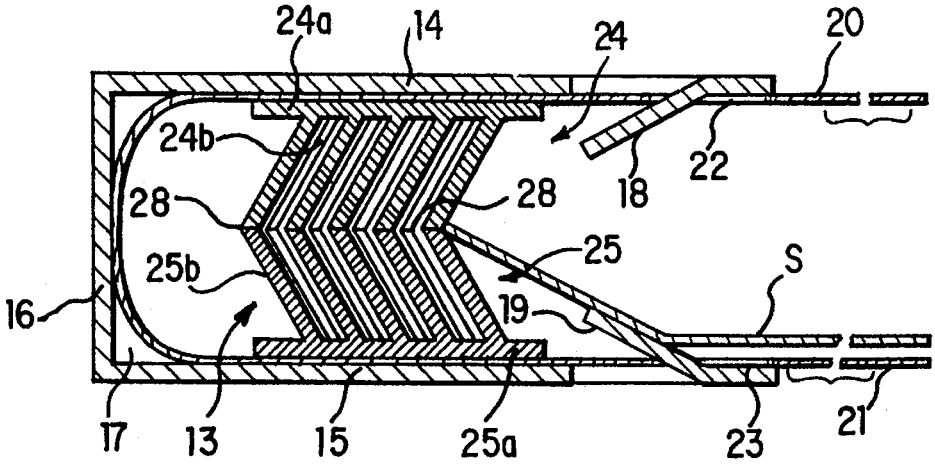
FIG. 3 is an enlarged section view taken along line 3—3 in FIG. 1.

Referring to FIGS. 1–3, a first embodiment of a file 10 of the invention is shown. The file 10 is designed to retain or hold sheets S therein. The file 10 is formed of an elongated base member 11, a cover 12 attached to the base member 11, and two gripping devices 13 situated in the base member 11.

The base member 11 includes an upper portion 14, a lower portion 15 and a back portion 16 situated between the upper and lower portions 14, 15 to thereby form a space 17. The upper portion 14 includes two guide members 18 spaced apart from one another, and the lower portion 15 also includes two guide members 19 at portions corresponding to the guide members 18. The guide members 18, 19 are formed by partly cutting the upper and lower portions 14, 15 and bending the same inwardly.

The base member 11 has sufficient rigidity, so that the distance between the upper and lower portions 14, 15 does not substantially change if the sheets are inserted into the file 10. Preferably, the base member 11 is formed integrally by resin. A long U-shape plastic member may be cut for a predetermined distance to form the base member 11, which is then partly cut and bent to form the guide members 18, 19 therein.

The cover 12 is made of flexible plastic and includes upper and lower portions 20, 21, and four openings 22, 23. The openings 22, 23 are formed in the cover 12 such that when the cover 12 is assembled with the base member 11, the guide members 18 are inserted through the openings 22, while the guide members 19 are inserted through the openings 23.

In the file 10, two gripping devices 13 are attached to the cover 12 between the upper and lower portions 14, 15. Each gripping device 13 is formed of upper and lower frictional members 24, 25. The upper frictional member 24 includes a base plate **24*a* and a plurality of hairs 24*b* extending obliquely from the base plate 24*a*, while the lower frictional member 25 includes a base plate 25*a* and a plurality of hairs 25*b* extending obliquely from the base plate 25*a*. The upper and lower frictional members 24, 25** are disclosed in U. S. Pat. No. 5,086,545, so that the detailed explanation thereof is omitted herein.

The upper frictional members 24 are attached to portions 26 in the cover 12, and the lower frictional members 25 are attached to portions 27 in the cover 12. When the cover 12 is attached to the base member 11, the hairs **24*b*, 25*b* abut against each other between the upper and lower portions 14, 15 and orient toward the back portion 16**.

When the file 10 is formed, the upper and lower frictional members 24, 25 are attached to the cover 12. Then, the cover 12 is folded into half and is inserted between the upper and lower portions 14, 15 such that the guide members 18 pass through the openings 22 and the guide members 19 pass through the openings 23, as shown in FIG. 3. In this position, the hairs **24*b*, 25*b* slightly abut against each other to form a holding surface 28 therebetween. The guide members 18, 19 are located in front of the upper and lower frictional members 24, 25. Since the guide members 18, 19 engage the openings 22, 23, the cover 12 does not disengage from the base member 11. However, the cover 12 may be fixed to the base member 11** by glue.

When the file 10 is used, the sheet or sheets S are simply inserted into the base member 11 between the upper and lower portions 20, 21 of the cover 12. The end of the sheet S is guided by the guide members 18 or 19, and is inserted between the frictional members 24, 25. The sheet is frictionally held between the frictional members 24, 25.

In the file of the invention, after the sheets are held between the frictional members 24, 25, additional sheets may be added between the frictional members 24, 25 by simply adding or pushing the sheets. If some of the sheets are removed, the required sheets are simply taken out of the file. The rest of the sheets are left between the frictional members 24, 25.

Figure 4:
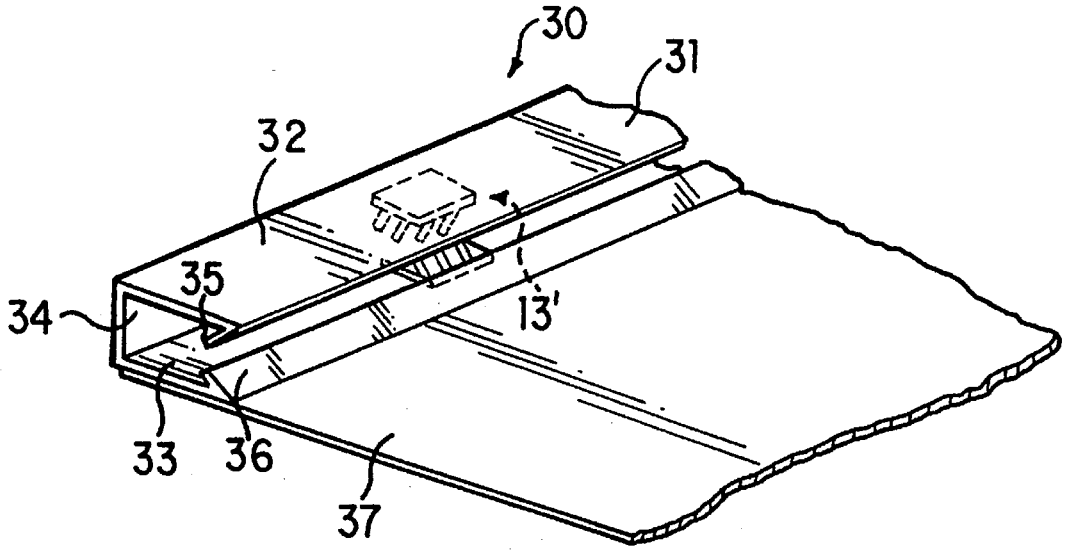
FIG. 4 is a partial perspective view of a second embodiment of a file of the invention.

FIG. 4 shows a second embodiment 30 of the file of the invention, which is formed of an elongated base member 31 and two gripping devices 13' attached to the base member 31. The base member 31 is formed of upper, lower and back portions 32, 33, 34, as in the first embodiment. However, in the file 30, upper and lower guide members 35, 36 are formed along the entire lengths of the respective upper and lower portions 32, 33, and the lower portion 33 is fixed to a back cover 37. The rest of the structure of the file 30 is the same as that of the file 10.

In the file 30, when the sheets are inserted into the base member 31, the sheets are guided by the guide members 35, 36 entirely extending along the edges of the upper and lower portions 32, 33. Therefore, the sheets are easily and smoothly guided into the gripping devices 13' and are held therein. The file 30 operates as in the file 10.

In the present invention, since the file is provided with the gripping devices, the sheets can be easily inserted into and removed from the file, even by one hand. Also, the sheets can be taken out from the file as desired.

While the invention has been explained with reference to the specific embodiments of the invention, the explanation is illustrative, and the invention is limited only by the appended claims.

What is claimed is:

1. A file for gripping sheets comprising, an elongated base member having front and back sides, said base member being formed of upper and lower portions disposed substantially parallel to each other, a back portion situated between the upper and lower portions at the back side thereof, and upper and lower guide members fixed to the upper and lower portions to face to each other at the front side, each guide member diagonally extending toward the back portion so that when the sheets are inserted between the upper and lower portions, the sheets are guided in a center area between the upper and lower portions, said upper and lower guide members being integrally formed with the upper and lower portions respectively, a part of the upper and lower portions being cut and bent inwardly to form the guide members, and at least two gripping devices fixed to the elongated base member at a predetermined distance away from each other along a longitudinal direction thereof, each of said gripping devices having upper and lower frictional members with elasticity, said upper frictional member being fixed to the upper portion and said lower frictional member being fixed to the lower portion to face to each other so that when the sheets are inserted between the upper and lower frictional members, the sheets are frictionally retained between the frictional members, said gripping devices being arranged such that the upper and lower guide members are formed at least at portions between each of the gripping devices and the front side of elongated base member to face to each other.

2. A file according to claim 1, further comprising a back cover attached to the lower portion at the front side of the elongated member.

3. A file according to claim 2, further comprising a front cover attached to the upper portion at the front side of the elongated member.

4. A file according to claim 3, wherein said front and back covers are integrally connected and situated inside the elongated base member, said gripping devices being fixed to the front and back covers.

5. A file for gripping sheets comprising, an elongated base member having front and back sides, said base member being formed of upper and lower portions disposed substantially parallel to each other, a back portion situated between the upper and lower portions at the back side thereof, and upper and lower guide members fixed to the upper and lower portions to face to each other at the front side, said upper guide member being formed along an entire length of the upper portion at the front side thereof, said lower guide member being formed along an entire length of the lower portion at the front side thereof, each of said upper and lower guide members diagonally extending toward the back portion to have a distal end thereat, said distal ends of the upper and lower guide members being spaced apart from each other to have a predetermined space therebetween and extending parallel to each other so that when the sheets are inserted between the upper and lower portions, the sheets are guided into the space between the upper and lower portions, and at least two gripping devices fixed to the elongated base member at a predetermined distance away from each other along a longitudinal direction thereof, each of the gripping devices having upper and lower frictional members with elasticity, said upper frictional member being fixed to the upper portion and said lower frictional member being fixed to the lower portion to face to each other so that when the sheets are inserted between the upper and lower frictional members, the sheets are frictionally retained between the frictional members.

6. A file according to claim 5, wherein each of the upper frictional members is located between the distal end of the upper guide member and the back portion, and each of the lower frictional members is located between the distal end of the lower guide member and the back portion.

7. A file according to claim 6, further comprising a back cover fixed to the lower portion of the base member, said upper and lower guide members being integrally formed with the upper and lower portions.

* * * * *